US008939639B2

(12) United States Patent
Heise

(10) Patent No.: US 8,939,639 B2
(45) Date of Patent: Jan. 27, 2015

(54) TOURBILLON

(71) Applicant: Glashuetter Uhrenbetrieb GmbH, Glashuette/Sachsen (DE)

(72) Inventor: Joern Heise, Rudolstadt (DE)

(73) Assignee: Glashuetter Uhrenbetrieb GmbH, Glashuette (DE)

( * ) Notice: Subject to any disclaimer, the term of this patent is extended or adjusted under 35 U.S.C. 154(b) by 0 days.

(21) Appl. No.: 14/250,659

(22) Filed: Apr. 11, 2014

(65) Prior Publication Data

US 2014/0313865 A1 Oct. 23, 2014

(30) Foreign Application Priority Data

Apr. 18, 2013 (EP) ..... 13164243

(51) Int. Cl.
*G04B 17/06* (2006.01)
*G04F 7/08* (2006.01)
*G04B 15/14* (2006.01)

(52) U.S. Cl.
CPC ..... *G04B 15/14* (2013.01); *G04F 7/0842* (2013.01); *G04B 17/06* (2013.01)
USPC ..... 368/105; 368/127; 368/169

(58) Field of Classification Search
CPC ... G04F 7/0842; G04F 7/0857; G04F 7/0861; G04B 17/06
USPC ..... 368/101, 105, 127, 169
See application file for complete search history.

(56) References Cited

U.S. PATENT DOCUMENTS

| | | | | | |
|---|---|---|---|---|---|
| 352,326 | A | * | 11/1886 | Jennings | 368/105 |
| 428,717 | A | * | 5/1890 | Dates | 368/105 |
| 458,348 | A | * | 8/1891 | Bourquin | 368/105 |
| 689,495 | A | * | 12/1901 | Johnson | 368/105 |
| 2006/0013072 | A1 | | 1/2006 | Golay | |

FOREIGN PATENT DOCUMENTS

| | | | |
|---|---|---|---|
| CH | 704 783 | A1 | 10/2012 |
| DE | 101 60 287 | A1 | 6/2003 |
| EP | 1 617 305 | A1 | 1/2006 |

OTHER PUBLICATIONS

European Search Report issued Nov. 12, 2013 in EP application 13164243, filed on Apr. 18, 2013 ( with English Translation).

* cited by examiner

*Primary Examiner* — Vit W Miska
(74) *Attorney, Agent, or Firm* — Oblon, Spivak, McClelland, Maier & Neustadt, L.L.P.

(57) ABSTRACT

The present invention relates to a tourbillon of a movement having:

a rotatably mounted rotating carriage (6) connected to a second pinion (46), a balance (12) mounted on the rotating carriage (6) relative to a balance shaft (28) and also having an escape wheel (16) mounted on the rotating carriage (6) and operatively connected to the balance (12) via a lever, characterized by:

a brake element (30) arranged on the rotating carriage (6), which can be brought into engagement with the balance (12) and is movable axially to the balance shaft (28).

15 Claims, 2 Drawing Sheets

TOURBILLON

TECHNICAL FIELD

This application claims priority from European Patent Application No. 13164243.1 filed 18 Apr. 2013 the entire disclosure of which is incorporated herein by reference.

The present invention relates to a tourbillon of a movement of a mechanical watch and also to a movement fitted with a tourbillon of this kind or a correspondingly equipped mechanical clock.

Tourbillons for mechanical clocks and movements have been known for some time. In these, the escape wheel, the lever and the so-called balance of the movement are arranged on a rotating carriage which is coupled with or respectively firmly connected to the arbor of the second wheel, consequently the second pinion. The balance or the balance shaft typically coincides with an imaginary axis extension of the second pinion in this case. A gear wheel connected to the escape wheel finally meshes with a fixed gear wheel disposed coaxially to the balance shaft, so that the tourbillon, and therefore the rotating carriage thereof, passes through a complete rotation every minute.

The accurate setting of a mechanical clock requires the second display to be stopped. In traditional existing movements, this is usually achieved by means of a so-called balance stop which can be activated by pulling out a crown, for example, and can be deactivated again by pushing in the crown.

In watches with a minute tourbillon, in which the second display is achieved directly by the rotating carriage of the tourbillon, the realization of a balance stop of this kind proves extremely difficult and complicated.

DE 101 60 287 A1 discloses for example a stop device for a tourbillon having a roughly V-shaped double-arm spring which can be moved from a basic position radially outside a rotating path of movement of the pillars of the tourbillon carriage into a blocking position. In the blocking position, the double-arm spring with spring arms directed in the opposite direction to the rotational direction of the balance contour can be resiliently placed against the radially rotating contour of the balance.

This kind of radial engagement with the balance may on the one hand prove detrimental to the extremely sensitive mounting of the tourbillon. On the other hand, a bearing position of the double-arm spring with the radially rotating and radially outwardly directed contour of the balance may influence the weights arranged on the balance rim and provided to regulate or set the balance in terms of their position or alignment. The danger here is that the double-arm spring affects the calibration or highly sensitive setting of the balance and therefore has a negative impact on the clock's precision, especially on its rate.

Furthermore, the balance stop described according to DE 101 60 287 A1, which is radially interacting with the balance rim, is probably scarcely suitable for flying tourbillons, since the double-arm spring acting on the tourbillon radially on one side would significantly affect the mounting of such a sensitively mounted tourbillon.

CN 201 402 376 U also shows a stop mechanism for a flying tourbillon. In this case, two collets are provided which can be brought into engagement radially with a central arbor of the second pinion facing away from the balance. However, only an indirect operative connection can be achieved with the clock balance in this case. The escape wheel can be stopped and locked by means of the collets, in which case that locking can be transferred via the lever to the oscillatingly mounted balance. To this extent, that stop mechanism may cause a subsequent oscillation of the balance when it is activated.

By contrast, the problem addressed by the present invention is that of providing an improved balance stop for a tourbillon of a mechanical clock. This should be capable of being integrated as simply as possible into an existing tourbillon design, for example, and, where possible, have only a slight impact on the mounting and positional stability of the tourbillon.

This problem is solved by means of a tourbillon of a movement according to Patent Claim 1 and also a corresponding clock according to Patent Claim 15, wherein advantageous embodiments are the subject matter of the dependent patent claims.

Accordingly, a tourbillon of a movement is provided which has a rotating carriage that can be connected to or coupled with a second pinion of the movement, which rotating carriage is rotatably mounted relative to a base plate of the movement. On that rotatably mounted carriage, and therefore on the rotating carriage, at least one balance mounted relative to a balance staff and also an escape wheel are rotatably mounted. The escape wheel in this case is located above a lever operatively connected to the balance. The balance, lever and escape wheel form the escapement of the mechanical movement in this case.

The tourbillon is furthermore characterized in this case by a brake element arranged on the rotating carriage, which can be brought into engagement with the balance and is movable axially to the balance axis. By means of a brake element of this kind, a balance stop can be achieved which exerts no radially asymmetric forces on the balance or on the rotating carriage of the tourbillon. By means of the brake element that can be brought into engagement axially with the balance, the balance can furthermore be braked directly, particularly stopped, by the brake element, as a result of which the rotational movement of the tourbillon, in other words the rotational movement of the rotating carriage, can be stopped.

Due to the axial movability of the brake element, it may engage in a braking manner possibly with an end face of the balance aligned in an axial direction or of a portion firmly connected to the balance. The balance can therefore be directly braked and stopped, so that upon activation of the balance stop there is no risk of subsequent oscillation of the balance. In addition, the radial symmetry of the tourbillon and its rotating carriage can remain largely unaffected by means of the axially movable brake element, so that the brake element is suitable particularly for the realization of a balance stop in the case of a flying tourbillon.

In addition, a balance stop can be achieved by the brake element acting in an axial direction, without the rotating carriage of the tourbillon having to be crossed in a radial direction for this purpose. Since the brake element only comes into direct operative contact with the balance and not with the rotating carriage of the tourbillon, it is furthermore conceivable with the brake element envisaged here for a stop of a minute tourbillon to be achieved, in which case the rotating carriage of the tourbillon could also be turned when the balance is stopped. In addition to this, the axially movable brake element allows the realization of a tourbillon, for example for chronograph displays or for undertaking short-time interval measurements.

According to a development, the brake element can be brought into engagement with the balance in a frictional manner to stop the balance. The frictional force exerted on the balance by the brake element may increase abruptly or constantly during activation of the brake element, so that a dampened stopping of the balance can be achieved to this extent.

By means of the frictional operative connection between the brake element and the balance, the balance can be stopped in any position or configuration irrespective of its current condition.

According to a further embodiment, the brake element has on a first, radially inwardly projecting portion an axially aligned second friction surface, which can be brought into engagement with a corresponding, axially aligned first friction surface of the balance. The brake element extends particularly radially inwards in the direction of the balance shaft. It projects virtually up to the balance shaft or the virtual extension thereof where it is able to engage with the balance in a braking or retarding manner, for example through a movement or deformation directed towards the balance in an axial direction.

The substantially axially aligned first and second friction surfaces of the balance and the first portion of the brake element are characterized by a surface normal vector extending in a substantially axial direction, in other words parallel to the balance shaft. Depending on the housing or movement of the brake element, an alignment that deviates slightly from the axial direction may also occur for the second friction surface provided on the first portion of the brake element, namely when the brake element pivots at least sectionally towards the balance or the brake element should be deformed elsewhere in an axial direction, for example.

According to a further embodiment, the brake element can be particularly brought into engagement axially with a disc or with a double roller. The brake element can be particularly brought into engagement with an end face of the disc or the double roller facing away from the balance or the balance rim. To this extent, the first friction surface of the balance that comes into engagement with the brake element is located on an end face of the roller or double disc facing the brake element.

First and second friction surfaces of the balance and brake element corresponding to one another may exhibit a friction-increasing surface quality, i.e. a predefined roughness. Depending on the brake force of the brake element to be applied, acting in an axial direction, a substantially smooth surface finish of at least one of the two friction surfaces is also conceivable, however.

According to a further embodiment, the first portion of the brake element aligned radially to the balance shaft has a fork-shaped or circular segment-shaped configuration for the at least sectional enclosure of the balance shaft. In this way, the first and second friction surfaces of the brake element and balance which come into the bearing position alternately can be maximized, particularly in order to maximize a braking or stopping function. The geometric embodiment of the fork-shaped, radially inwardly projecting free end of the brake element enables subsequent assembly of the brake element, on the rotating carriage of the tourbillon for example, particularly when the balance is already mounted on the rotating carriage.

Furthermore, the radially inwardly projecting, fork-shaped or circular-segment-like end of the brake element may be adapted to the corresponding outer contour of the first friction surface of the balance, so that the largest possible surface proportion of the first friction surface on the balance side can be brought into frictional engagement with the brake element.

It may be furthermore provided in this case that the brake element can be arranged on a side of the rotating carriage radially and diametrically opposite the escape wheel. In this way, the centre of gravity of the rotating carriage can be further centred.

Alternatively to a fork-shaped embodiment of the brake element, a ring-like embodiment of the brake element is conceivable, wherein the brake element then completely encloses the balance shaft and is mounted at least sectionally or also completely axially displaceably relative to the balance shaft. By means of a ring-like embodiment of the brake element, a radially symmetrical braking and stopping of the balance, and therefore of its disc or double roller, can take place.

According to a further embodiment, the brake element has a second portion spaced apart from the first portion radially. Using this second portion, the brake element is firmly connected to the rotating carriage of the tourbillon. Consequently, the brake element with the rotating carriage also rotates about the balance shaft, which typically coincides with the axis of rotation of the rotating carriage.

Typically, the first and second portions of the brake element referred to previously are free end portions of the brake element. Since the brake element is firmly connected to the rotating carriage by its second portion forming a second end, the end portion lying opposite may, for example, be moved in an axial direction relative to the rotating carriage and therefore also relative to the balance. A firm connection to the rotating carriage is particularly easy to achieve using a screw connection, for example. Due to its flexibility and a suitable choice of material for the brake element, the first portion can nevertheless be moved in relation to the rotating carriage, at least in an axial direction.

According to a further embodiment, the brake element can be deformed in an axial direction against a restoring force. It is particularly envisaged in this case that the brake element will be configured in a flexibly deformable manner. The restoring force against which the brake element can be deformed in an axial direction is applied by the elastic properties of the brake element in this case.

The brake element may to this extent be configured as a flexibly deformable leaf or as a flexibly deformable spring, roughly similar to a leaf spring, which is only arranged with one end, namely with its second portion, on the rotating carriage and is firmly connected to the rotating carriage there. The opposite end portion, so the first portion provided with a second friction surface, of the brake element can then be moved flexibly in an axial direction, in order to come into braking engagement with the balance, particularly in an axial direction.

The rotating carriage of the tourbillon typically has a wheel-like or circular geometry, wherein an outer rim or ring-like edge is connected to a hub via a plurality of spokes extending in a radial direction. The hub may be connected to the second pinion in a rotationally secured manner in this case and also coincide in relation to its rotational axis with the balance shaft or with the extension thereof.

By means of the fastening of the brake element to a spoke of the rotating carriage, a radially spaced fastening of the brake element to the hub or to the disc or double roller of the balance can take place, so that the first portion of the brake element provided with the second friction surface, which projects radially inwards and therefore into the region of the hub, can be configured in a flexibly deformable manner in an axial direction in relation to the rotating carriage.

According to a further embodiment, the brake element can be moved in an axial direction from the release position into a braking or locking position by means of an actuating element displaceable axially relative to the rotating carriage. The actuating element in this case may be configured to press against the brake element in an axial direction in such a manner that the first portion of the brake element is removed from the rotating carriage and moved in an axial direction towards the balance and comes into engagement therewith, particularly with the disc or double roller thereof.

It is particularly envisaged in this case that the actuating element is located between the first and the second portion, or else between the opposite ends of the brake element, viewed in the radial direction. In this way, a flexible deformation of the brake element can be brought about by an axial displacement of the actuating element, through which the first portion of the brake element provided with the second friction surface can be brought into direct engagement with the balance.

The elastic deformability of the brake element may further mean in this case that the actuating element displaceable in the axial direction can be moved back into an initial position by the restoring force of the brake element when activation abates or during deactivation.

According to a further embodiment, the actuating element is also held in an axially displaceable manner in a guide connected to the rotating carriage. The guide may be arranged in the region of the hub of the rotating carriage in this case or directly integrated in that hub. The guide and also the actuating element guided therein in an axial direction and also the brake element are consequently arranged on the rotating carriage of the tourbillon and rotate therewith during operation of the movement.

According to a further embodiment, the actuating element is supported axially against a ring that can be displaced axially in relation to the guide. The ring encloses the guide in this case in a region facing away from the balance. Through a displacement of the ring in relation to the guide in the direction of the balance, the actuating element supported axially on the ring can likewise be displaced in the direction of the balance, as a result of which the brake element also experiences a displacement directed towards the balance or deformation.

Finally, the actuating element can be raised by a lifting of the ring directed towards the balance and the brake element can thereby be pushed upwardly against the balance, particularly against the disc or double roller thereof.

It should be noted at this point that designations, such as those used above or below, are simply meant for illustrative purposes. In the embodiment provided for here, the balance, for example, is located above the brake element and, accordingly, also above the actuating element and guide. Other embodiments or alternative embodiments may, however, provide for a reverse configuration. A displacement or movement in the direction of the balance therefore equates to an upward displacement or movement and vice versa.

According to a further embodiment, the aforementioned ring can be displaced axially against a spring force in the direction of the balance, upwardly in the present case. That spring force may be provided by an expanding or plate spring, for example, which is arranged axially between the ring and the guide or else the hub of the rotating carriage.

In this way, the ring can be held in an initial position facing away from the balance. When the balance stop is activated, on the other hand, an axial displacement of the ring against the force of that spring is foreseen, as a result of which the brake element can finally be raised axially.

According to a development, the ring may be operatively connected particularly to a plurality of actuating elements which are displaceably held in an axial direction, for example, over the periphery of the guide or over the periphery of the hub in corresponding guide receiving means. In this way, a largely radially symmetrical lifting of the ring can be achieved, so that during the course of an axial movement in relation to the guide or in relation to the hub, the ring is guided as well and smoothly as possible and is not inclined to tilt.

According to a further embodiment, the ring has on its outer periphery facing away from the balance, so on its lower radially external edge, for example, a starting incline which is configured in a manner corresponding to the starting incline of a radially movable actuator that can be brought into a bearing position with the ring. The actuator may be configured in the form of a radially pivotable click, for example.

As a result of a radially inwardly directed movement of the actuator element, the ring can in this way be raised against the spring force in the direction of the balance. Advantageously in this case, at least two actuators which are roughly diametrically opposite on the ring and can be brought into a bearing position are provided, so that the ring can be raised from the rest position in as uniform and tilt-free a manner as possible.

The actuator may furthermore be coupled with a push-piece or with a setting lever via a lever mechanism. Finally, the actuator can be moved in a radial direction by a push-piece or via the winding crown of the movement, so that the starting inclines of the actuating element configured in a click-like fashion are able to lift the ring similarly to a vertical chronographic coupling.

The actuators elements in this case may furthermore be under spring tension and may likewise be coupled with one or a plurality of spring elements.

According to a further embodiment, the tourbillon is particularly configured as a flying tourbillon. The brake element acting in an axial direction may be particularly integrated into existing flying tourbillon designs at little design expense in this case. In addition, the brake mechanism is barely visible from the dial side. In particular, the brake system described here has no effect on the function of the tourbillon and its rotating carriage while the clock is running.

Finally, according to a further independent aspect, a mechanical clock such as a wristwatch, a pocket watch or a wall clock is provided, which exhibits a movement with a previously described tourbillon.

BRIEF DESCRIPTION OF THE FIGURES

Further aims, features and also advantageous possible applications are explained in the following description of an exemplary embodiment with reference to the drawings. In the drawings.

DETAILED DESCRIPTION

Figure 1:
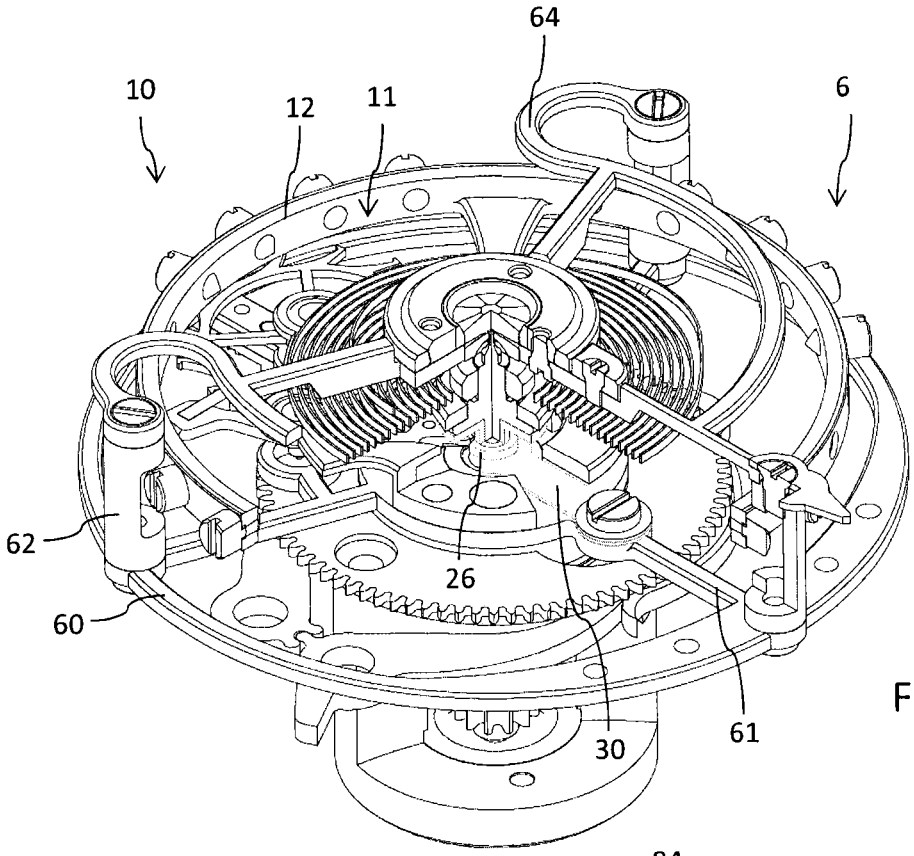
FIG. 1 shows a partially sectional perspective representation of the tourbillon.
Figure 3:
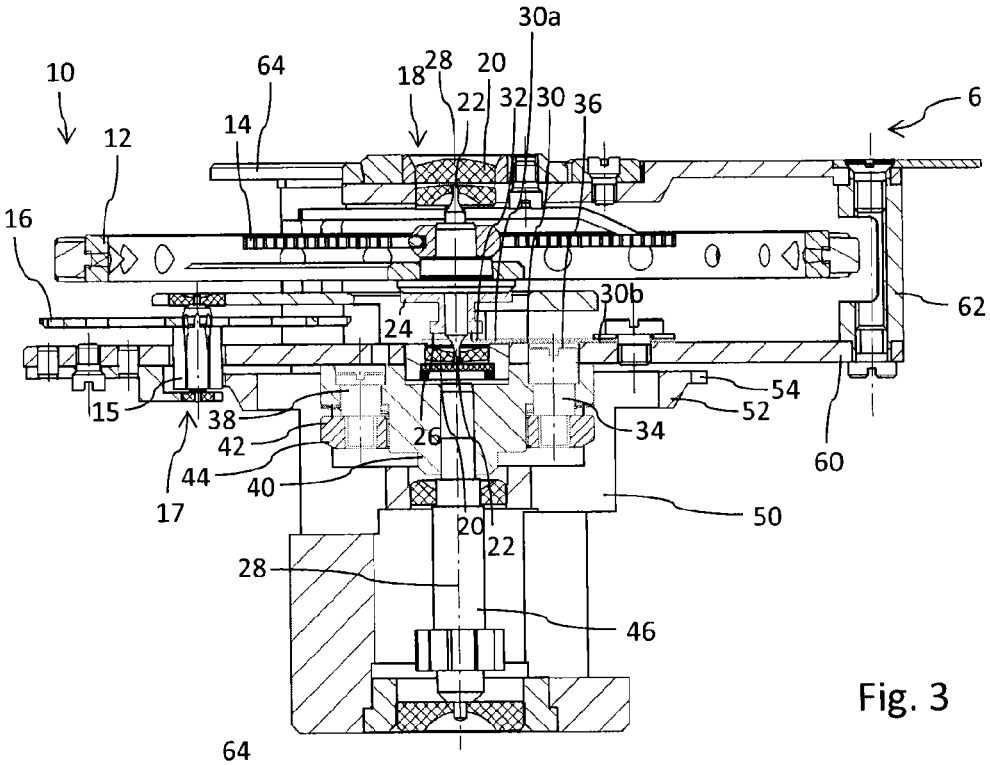
FIG. 3 shows a cross section through the tourbillon with the brake element deactivated and FIG. 4 shows a cross section through the tourbillon with the brake element activated and with the balance stopped.
Figure 4:
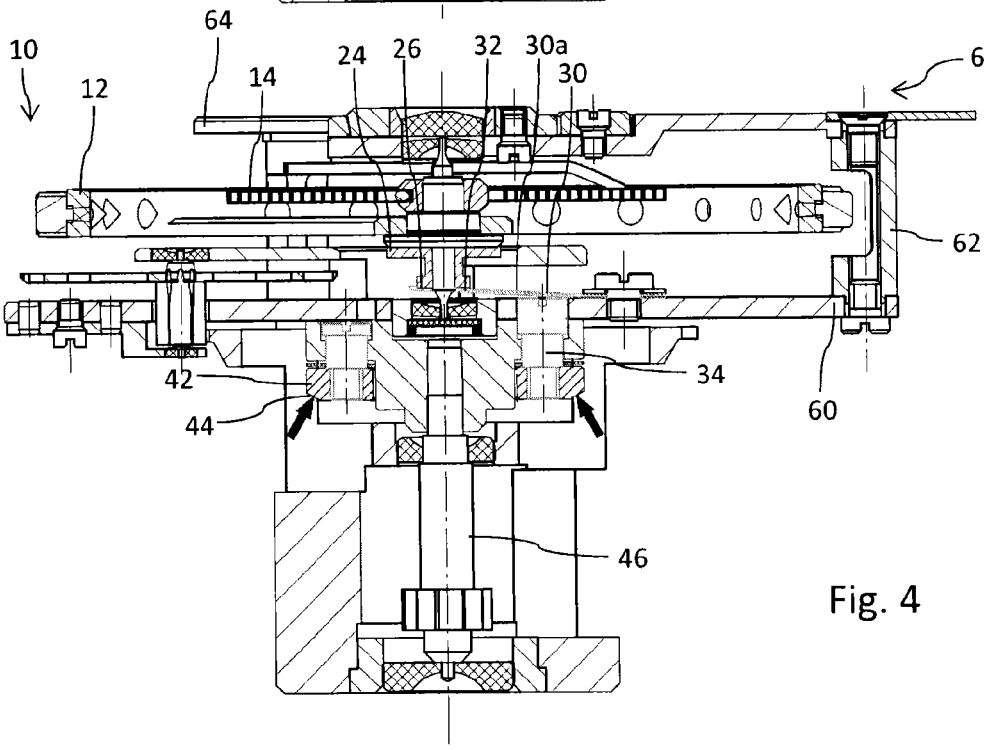

A tourbillon 10 of a mechanical movement not shown in greater detail in the present case is depicted in FIGS. 1, 3 and 4. The tourbillon 10 has a rotating carriage 6 which exhibits a lower carriage 60 with various radially aligned spokes 61, wherein on the outer ring of the lower carriage 60 three pillars 62 distributed over the periphery of the lower carriage 60 are provided, to which pillars an upper carriage 64 is secured. The carriages 60, 64 are furthermore connected in a non-rotational manner to a flange-shaped hub 40 which, as shown in FIG. 3, is coupled in a non-rotational manner with the second pinion 46.

The hub 40, and therefore the entire rotating carriage 6, is rotatably mounted in relation to a fixed wheel 50, which can also be referred to as a lower block 50. The fixed wheel 50 has, as shown in FIG. 3, a flange-like gear wheel portion 52 with a first external toothing 54 on its upper end portion. A gear wheel 15 connected to an escape wheel 16 meshes with that first external toothing 54. The gear wheel 15 and escape wheel 16 are arranged coaxially to one another in this case and are both mounted on the rotating carriage 6 via a first bearing 17. A rotation of the escape wheel 16 leads to a corresponding rotation of the entire rotating carriage 6 to this extent in relation to the lower fixed wheel 50.

Also depicted in FIGS. 1, 3 and 4 is a balance 12 with a balance spring 14 of an escapement 11. The balance 12 in this case is mounted on the rotating carriage 6 via a balance bearing 18 which defines a balance shaft 28. The balance bearing 18 in this case is characterized by bearing bushings 22, which interact with corresponding friction jewels 20 on the carriage side. The lever of the escapement 11 is not shown in the present figures; to this extent the escapement 11 is only partially shown in FIGS. 1 to 4.

On the balance bearing 18 a double roller 24 with a downwardly projecting first friction surface 26 on the end face is provided below the balance wheel. By means of the lower bearing bushing 22 and its axial support on the corresponding friction jewel 20, an axial gap is formed between the first friction surface 26 and the hub 40. An axially effective brake element 30 projects into that gap, which element lies flat on the upper side of the lower carriage 60 in the representation according to FIGS. 1 and 3.

The brake element 30 is therefore arranged below the rotating carriage 6 and is located axially between the rotating carriage 6 and the fixed wheel 50. The braking mechanism is therefore barely visible viewed from the dial side. This is particularly advantageous for aesthetic reasons for a flying tourbillon which does not have a bridge and therefore provides a complete view of the entire rotating carriage, without it being partially concealed by another element of the main-plate. For an arrangement of this kind, the integration of the brake mechanism is comparatively simple on the one hand, as the structural interference with an existing embodiment of a flying tourbillon is small. On the other hand, the aesthetic advantages of the flying tourbillon as compared with a customary tourbillon are still guaranteed.

The brake element 30 in this case has a first portion 30*a* provided with an axial second friction surface 32 directed upwards towards the balance 12, which, as shown in FIG. 4, can push against the first friction surface 26 of the double roller 24 from below. In this way, a braking and locking function can be exerted on the double roller 24 by means of the brake element 30 and therefore directly on the balance 12 rigidly connected thereto.

The brake element 30 in the present case is configured as a kind of brake spring. It also has a second portion 30*b* opposite the first portion 30*a*, via which the brake element 30 is connected to the lower carriage 60. As shown in FIGS. 1 and 3, the second portion 30*b* of the brake element 30 may be screwed to a spoke 61 of the lower carriage 60.

A cylindrical recess or a corresponding guide hole in the hub 40, i.e. the guide is located radially between the first and the second portion 30*a*, 30*b*. In that recess, as shown in FIGS. 3 and 4, an actuating element 34 is guided displaceably in an axial direction. A lower end portion of the actuating element 34 is configured in a radially tapered manner in relation to an actuating element head 36 and is supported via a radial graduation on a ring 42 enclosing the hub 40.

A spring element 48 is arranged axially between the ring 42 and a lower portion of the hub 40 broadened in a flange-like manner, which element may be configured as an expanding spring, for example. In this way, the ring 42 can be displaced upwardly and therefore axially to the balance 12 against the action of the spring element 48. That axial displacement movement of the ring 42 leads to a corresponding axial displacement of the actuating element 34, which is configured as an adjusting bolt in the present case.

As a result of an axial displacement, an upper head 36 of the actuating element 34 comes into abutment on an underside of the brake element 30 in such a manner that it lifts the radially inwardly projecting free end of the brake element 30 and therefore pushes the second friction surface 32 thereof against a first friction surface 26 of the double roller 24 corresponding thereto. Due to the reciprocal friction between the second and the first friction surface 32, 26, the brake element 30 may exert a braking effect on the balance 12.

As shown in FIGS. 3 and 4, the ring 42 may be guided via a plurality of bolts 34, 38 in an axially displaceable manner on the hub 40. The second bolt 38 is substantially without a function in relation to the operation of the brake device. Via the second bolt 38, however, a particularly smooth, tilt-free axial displacement of the ring 42 relative to the hub 40 can be achieved.

In order to activate the braking or locking function, a force acting in an axial direction must be exerted on the ring 42, as indicated by the arrows in FIG. 4. An actuating device of this kind is sketched by way of example in the perspective drawing according to FIG. 2. In this case, two first and second actuators 70, 70*a* arranged symmetrically to one another, coupled directly with one another via a second toothing 71, are provided, which actuators are secured by means of a second bearing 76 and by means of a third bearing 76*a* pivotably in each case, e.g. to the main-plate of the movement.

The free ends of the first and second actuators 70, 70*a* are configured as a click 72, each being provided with a second starting incline 74, which are configured to correspond to a first starting incline 44 provided on the lower outer edge of the ring 42. By radially inwardly directed tilting of the first and second actuator 70, 70*a* in relation to the ring 42, the ring 42 can be lifted against the restoring force of the spring element 48 through the interaction of the first and second starting inclines 44, 74 of the ring 42 corresponding to one another.

Accordingly, the actuating element 34 also experiences a corresponding axial movement, which ultimately leads to the braking lifting of the radially inwardly directed free end portions 30*a* of the brake element 30.

Figure 2:
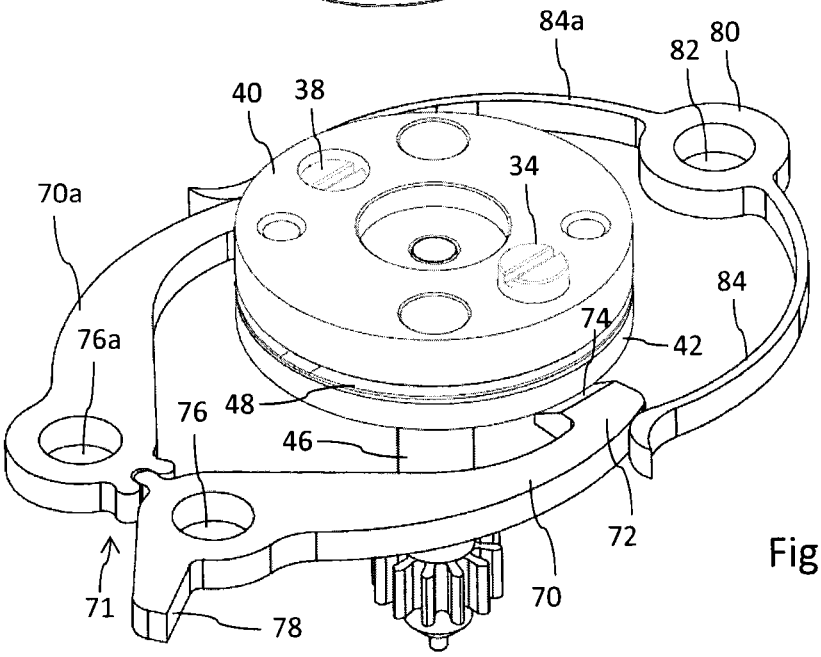
FIG. 2 shows a perspective representation of the tourbillon hub and two actuators that can be brought into engagement therewith.

As also indicated in FIG. 2, the first and second actuators 70, 70*a*, particularly their click 72 coming directly into abutment with the ring 42, can act together with a further spring element 80, which exhibits two spring arms 84, 84*a*, i.e. a first spring arm 84 and a second spring arm 84*a* each of which aim to push the clicks 72 radially inwardly. The double-arm springs 80 depicted here may in this case be fastened in the region of a fourth bearing 82 likewise to the main-plate of the movement.

Activation of the balance stop depicted here may take place through the effects of force or torque on an actuating end 78 of the click arm. For example, by tightening a winding crown or by activating a push-piece, an otherwise permanently acting force on the actuation end 78 may be reduced in such a way that the first and second actuating elements 70 and 70*a* lift the ring 42 under the influence of the double-arm spring 80 and therefore activate the brake acting axially on the balance 12.

It is furthermore noted below that the exemplary embodiment shown in this case only demonstrates a possibility for the practical implementation of the invention defined in the patent claims. Under no circumstances is the invention to be limited to the exemplary embodiment shown here, but it may be implemented in a plurality of ways in the manner demonstrated by the following patent claims and combinations thereof.

LIST OF REFERENCE NUMBERS

6 Rotating carriage
10 Tourbillon
11 Escapement
12 Balance
14 Balance spring
15 Gear wheel
16 Escape wheel
17 First bearing
18 Balance bearing
20 Friction jewel
22 Bearing bushing
24 Double roller
26 First friction surface
28 Balance shaft
30 Brake element
30*a* First portion
30*b* Second portion
32 Second friction surface
34 Actuating element
36 Head
38 Bolt
40 Hub
42 Ring
44 First starting incline
46 Second pinion
48 Spring element
50 Fixed wheel
52 Gear wheel portion
54 First toothing
60 Lower carriage
61 Spoke
62 Pillar
64 Upper carriage
70 First actuator
70*a* Second actuator
71 Second toothing
72 Click
74 Second starting incline
76 Second bearing
76*a* Third bearing
78 Actuation end
80 Spring
2 Fourth bearing
84 First spring arm
84*a* Second spring arm

What is claimed is:

1. A tourbillon of a movement having:

a rotatably mounted rotating carriage connected to a second pinion, a balance mounted on the rotating carriage relative to a balance shaft and also having an escape wheel mounted on the rotating carriage and operatively connected to the balance via a lever, characterized by:

a brake element arranged on the rotating carriage, which can be brought into engagement with the balance and is movable axially to the balance shaft.

2. The tourbillon according to claim 1, wherein the brake element can be brought into engagement with the balance in a frictional manner to stop the balance.

3. The tourbillon according to claim 2, wherein the brake element has on a first, radially inwardly projecting portion an axially aligned second friction surface, which can be brought into engagement with a corresponding, axially aligned first friction surface of the balance.

4. The tourbillon according to claim 3, wherein the brake element can be brought into engagement axially with a disc or with a double roller of the balance.

5. The tourbillon according to claim 4, wherein the first portion of the brake element aligned radially to the balance shaft has a fork-shaped configuration for the at least sectional enclosure of the balance shaft.

6. The tourbillon according to claim 5, wherein the brake element is firmly connected to the rotating carriage by means of a second portion spaced apart from the first portion radially.

7. The tourbillon according to claim 6, wherein the brake element can be deformed in an axial direction against a restoring force.

8. The tourbillon according to claim 7, wherein the brake element is fastened to a spoke of the rotating carriage extending in a radial direction.

9. The tourbillon according to claim 8, wherein the brake element can be moved in an axial direction from a release position into a braking or locking position by means of an actuating element displaceable axially relative to the rotating carriage.

10. The tourbillon according to claim 9, wherein the actuating element is held in an axially displaceable manner in a guide connected to the rotating carriage.

11. The tourbillon according to claim 10, wherein the actuating element is supported axially against a ring that can be displaced axially in relation to the guide.

12. The tourbillon according to claim 11, wherein the ring can be displaced axially against a spring force in the direction of the balance.

13. The tourbillon according to claim 12, wherein the ring has on its outer periphery facing away from the balance a first starting incline which is configured in a manner corresponding to the starting incline of a radially movable first actuator that can be brought into a bearing position with the ring.

14. The tourbillon according to claim 1, which is configured as a flying tourbillon.

15. A clock having a tourbillon according to claim 14.

* * * * *